US005751624A

United States Patent [19]

Zhou et al.

[11] Patent Number: 5,751,624

[45] Date of Patent: May 12, 1998

[54] COMPLEX NUMBER CALCULATION CIRCUIT

[75] Inventors: Changming Zhou; Guoliang Shou; Makoto Yamamoto; Sunao Takatori, all of Tokyo, Japan

[73] Assignees: Sharp Kabushiki Kaisha, Osaka; Yozan Inc., Tokyo, both of Japan

[21] Appl. No.: 715,732

[22] Filed: Sep. 19, 1996

[30] Foreign Application Priority Data

Sep. 20, 1995 [JP] Japan ..... 7-264645
Sep. 28, 1995 [JP] Japan ..... 7-274839

[51] Int. Cl.[6] ..... G06C 15/08

[52] U.S. Cl. ..... 364/841; 341/155

[58] Field of Search ..... 341/155, 141; 364/841, 754, 760; 327/403, 354, 353, 356, 407

[56] References Cited

U.S. PATENT DOCUMENTS

| | | | |
|---|---|---|---|
| 3,926,367 | 12/1975 | Bond et al. | 364/841 |
| 4,747,067 | 5/1988 | Jagodnik, Jr. et al. | 364/715 |
| 5,119,037 | 6/1992 | Ichiyoshi | 328/155 |
| 5,420,806 | 5/1995 | Shou et al. | 364/606 |

FOREIGN PATENT DOCUMENTS 7-94957 4/1995 Japan .

OTHER PUBLICATIONS

"Dual 64–TAP, 11 Mcps Digital Matched Filter/Correlator Stel 3310", Stanford Telecom, 1990, Jul. 1990, pp. 125–126, 130, 136.

*Primary Examiner*—Marc S. Hoff
*Assistant Examiner*—Peguy JeanPierre
*Attorney, Agent, or Firm*—Cushman Darby & Cushman IP Group of Pillsbury Madison & Sutro LLP

[57] ABSTRACT

A complex number calculation circuit for directly multiplying a complex number of an analog signal by a digital complex number as a multiplier. A capacitive coupling is used with a plurality of parallel capacitances corresponding to weights of bits of real and imaginary parts of the multiplier. The sign of the multiplier is represented by selection of output paths. A complex number calculation circuit for calculating approximated absolute values is suitable for an analog architecture. Inverter circuits are used for linear inversion of analog values, and capacitive couplings are used for weighted addition. Analog maximum and minimum circuits with parallel MOSs are used for maximum and minimum calculation.

24 Claims, 10 Drawing Sheets

COMPLEX NUMBER CALCULATION CIRCUIT

FIELD OF THE INVENTION

The present invention relates to a complex number calculation circuit, for a multiplication circuit effective to filtering signal or orthogonal transformation, and for an absolute value calculation applicable for receiving a signal sent as a real part (a component I) and an imaginary part (a component Q) in the communication field.

BACKGROUND OF THE INVENTION

Conventionally, various operations of this kind are processed by a digital circuit such as a DSP. When the signal to be processed is an analog signal, A/D conversion is indispensable, and there are many cases where a signal after processing is again converted into analog data. The present applicants have developed LSIs for various analog signal processing including an operator for directly multiplying digital data with analog data, and have also realized miniaturization and low electric power consumption of such devices. However, there are no complex number multiplication circuits applicable to such an analog architecture.

It is difficult for an absolute value operation to be replaced by digital hardware because the operations of square and root are necessary to perform the absolute value operation. Therefore, generally, an approximating formula is performed by the DSP (Digital Signal Processor). Stanford Telecom in the U.S. has developed a LSI for performing the approximating formula below, and this formula is highly rated.

$$\mathrm{Mag} = \mathrm{Max}\{\mathrm{Abs}(I),\mathrm{Abs}(Q)\} + \frac{1}{2}\,\mathrm{Min}\{\mathrm{Abs}(I),\mathrm{Abs}(Q)\} \tag{16}$$

Here,

Mag: The absolute value of a complex number.

Max { }: The maximum value.

Min { }: The minimum value.

Abs { }: The absolute value.

The inventors of the present invention have proposed various operation circuits and filter circuits using analog processing. A digital LSI is unsuitable to this kind of analog architecture.

SUMMARY OF THE INVENTION

The present invention solves the above conventional problems and has an object to provide a complex number calculation circuit which can directly multiply a digital complex number with a complex number given by an analog signal.

The present invention also has an object to provide a circuit for performing an absolute value operation which is suitable for an analog architecture.

In a complex number multiplication circuit according to the present invention, a capacitive coupling is used in which a plurality of capacitances corresponding to weights of bits of a digital multiplier are arranged in parallel, and a digital multiplier is multiplied to the complex number given by an analog voltage. The path is switched according to the polarities of the real part or the imaginary part and one or two inverted amplifiers are passed, as well as the multiplication results are added by the capacitive coupling. An output is in analog voltage form.

It is possible to calculate a conventional approximate formula and an improved formula using i) a first inverter circuit to which a first input voltage corresponding to a real part of a complex number is connected;

ii) a second inverter circuit to which a second voltage corresponding to an imaginary part of the complex number is connected;

iii) a first maximum circuit to which the first and second voltages and outputs of the first and second inverter circuits are connected;

iv) a second maximum circuit to which the first voltage and the output of the first inverter circuit are connected;

v) a third maximum circuit to which the second voltage and the output of the second inverter circuit are connected;

vi) a minimum circuit to which outputs of the second and third maximum circuits are connected;

vii) a capacitive coupling with a plurality of capacitances connected at outputs thereof with one another, to which an output of the minimum circuit and an output of the first maximum circuit are connected so that the outputs of the minimum circuit and the first maximum circuit are weighted by a ratio of 1:2;

viii) a third inverter circuit to which an output of the capacitive coupling is connected; and ix) a fourth inverter circuit to which an output of the third inverter circuit is connected.

of a complex number calculation circuit for calculating an absolute value according to the present invention.

It is possible to directly multiply a complex number given by an analog signal and the operation results can be obtained as an analog voltage by the complex number multiplication circuit according to the present invention. Furthermore, an absolute value can be obtained as an analog voltage from analog real and imaginary parts of a complex number.

PREFERRED EMBODIMENT OF THE PRESENT INVENTION

Hereinafter the first embodiment of the complex number calculation circuit according to the present invention is described with reference to the attached drawings.

Figure 1:
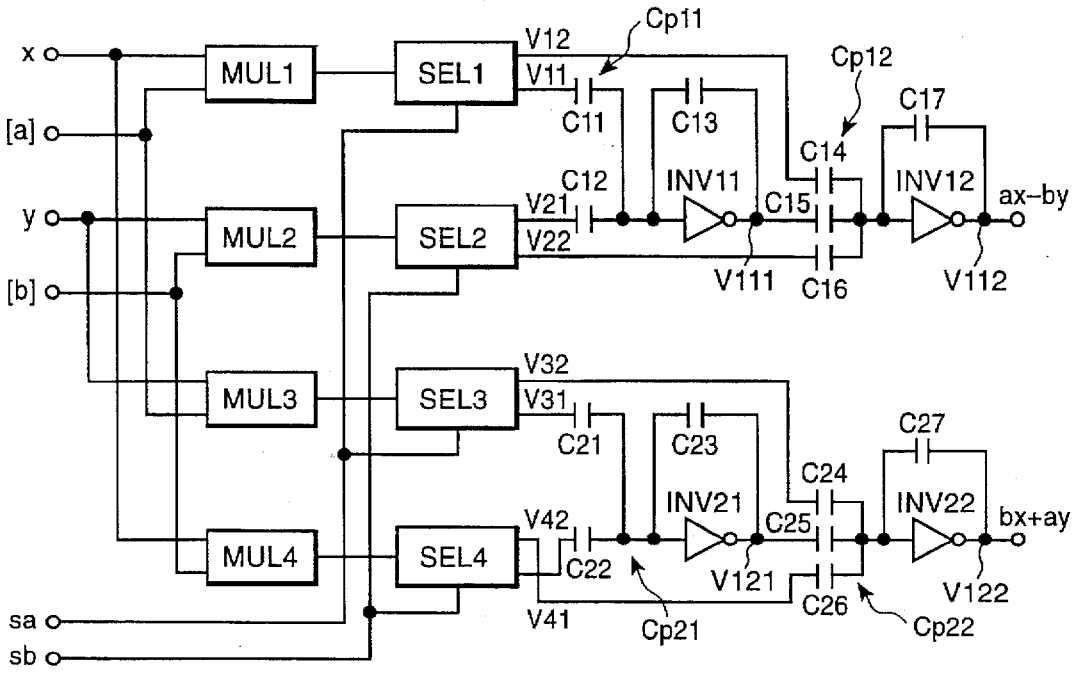
FIG. 1 shows the first embodiment of a complex number multiplication circuit according to the present invention.

In FIG. 1, a complex number multiplication circuit includes the first multiplication circuit MUL1 and the fourth multiplication circuit MUL4 to both of which the real part x of a complex number (x+iy) is applied as an input, and the second multiplication circuit MUL2 and the third multiplication circuit MUL3 to both of which the imaginary part y of a complex number (x+iy) is applied as inputs. The absolute value |a| of the real part of the second complex number (a+ib) is applied as an input to the first and the third multipliers, and the absolute value |b| of the imaginary part is applied as an input to the second and the fourth multipliers. x and y are applied as an analog voltage, and |a| and |b| are applied as a digital signal.

In the multiplication circuits MUL1 to MUL4, the operations below are performed.

The First Multiplier MUL1: −|a|x (1)

The Second Multiplier MUL2: −|b|y (2)

The Third Multiplier MUL3: −|a|y (3)

The Fourth Multiplier MUL4: −|b|x (4)

The products of (x+iy) and (a+ib), that is formula (5) can be obtained by combining them.

$$(x+iy)(a+ib)=(ax-by)+i(by+ay) \quad (5)$$

Figure 4:
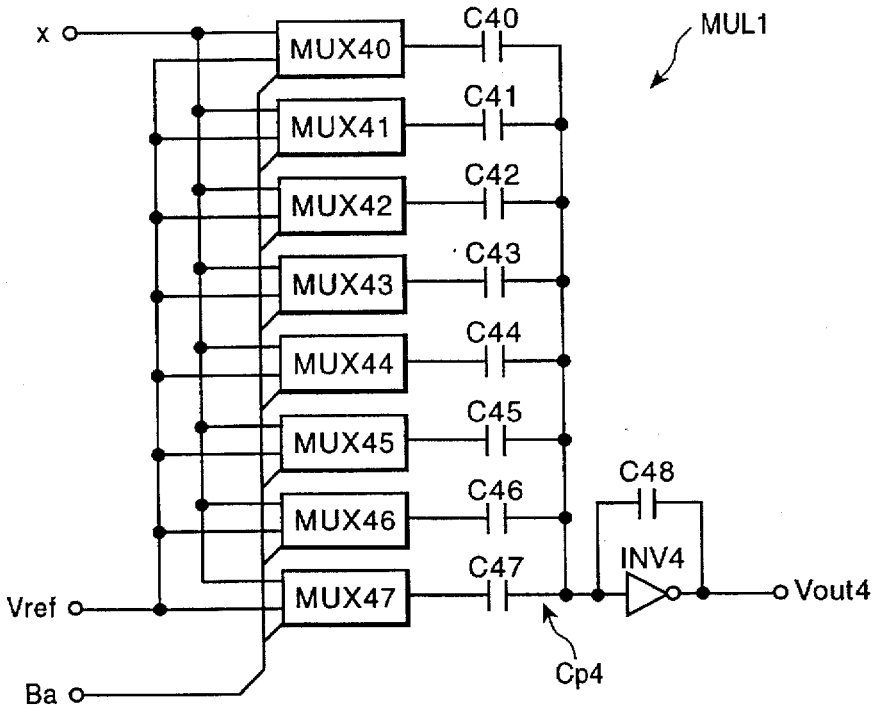
FIG. 4 shows a multiplication circuit used in the embodiment.

As in FIG. 4, the first multiplication circuit MUL1 includes a plural number of multiplexers MUX40 to MUX47, to which an analog input x is commonly applied as an input. The inputs to the multiplexers include a reference voltage Vref corresponding to an analog input 0 and each bit of a digital signal representing the absolute value |a| of the real part of the second complex number. Assuming that each bit of |a| is Ba0, Ba1, Ba2, Ba3, Ba4, Ba5, Ba6, and Ba7 from the least significant bit to the most significant bit, they are successively applied as inputs to MUX40 through MUX47. In FIG. 4, the whole of the digital signal is shown by Ba. The multiplexers MUX40 to MUX47 output x when their respective bits Ba to Ba7 are 1, and they output Vref when BaO to Ba7 are 0.

A capacitive coupling Cp4 constructed by capacitances C40 to C47 is connected to the outputs of MUX40 to MUX47. Each capacitance is connected to the corresponding multiplexer, and their outputs are integrated. An output of the capacitive coupling Cp4 is applied as an input to an inverting amplifier including an inverter circuit INV4 and a feedback capacitance C48, then, a multiplication result is generated as an output of an inverting amplifier Vout4. The ratio of capacitances C40 to C47 and C48 is

C40:C41:C42:C43:C44:C45:C46:C47:C48=
1:2:4:8:16:32:64:128:255 (6)

Assuming the supply voltage of INV4 is Vdd, Vout 4 can be expressed as in formula (7).

$$Vout4 = Vdd - \frac{\sum_{i=0}^{7} X(Bai)C4i}{C48} \quad (7)$$

An analog voltage X corresponds to a negative value when 0≦X<Vref, X=0 when X=Vref, and corresponds to a positive value when Vref<X≦Vdd.

INV4 is a circuit of high open gain which prevents an unstable oscillation using a grounded capacitance and a balancing resistance. It has good linearity regardless of the load in the following stages. This circuit is described in detail in Japanese open-laid publication of 7-94957 filed on Sep. 20, 1993.

As above, the multiplication circuit directly multiplies the complex number given as an analog voltage and generates an analog output. Since the structures of the other multipliers MUL2 to MUL4 are the same as MUL1, their descriptions are omitted.

Outputs of each multiplier MUL1 to MUL4 are applied as inputs to selector SEL1 to SEL4, each of which has an input and two outputs. The path of the output is selected according to the polarity of the real part and the imaginary part of the second complex number as shown in FIG. 1. The code bit "sa" of the real part a is applied as an input to the selectors SEL1 and SEL3, and the code bit "sb" of the imaginary part b is applied as an input to the selectors SEL2 and SEL4. The outputs of SEL1 and SEL2 are connected to capacitive couplings Cp11 or Cp12. The outputs to Cp11 and Cp12 are defined to be the first line and the second line, respectively. The outputs of SEL3 and SEL4 are connected to the capacitive coupling Cp21 or Cp22. The outputs to Cp21 and Cp22 are defined to be the first and the second lines, respectively.

The first and second paths (lines) are selected according to the condition in TABLE 1.

TABLE 1

CONDITION OF SELECTING OUTPUT OF SELECTOR

| LINE | SEL1 | SEL2 | SEL3 | SEL4 |
|---|---|---|---|---|
| The First Line | a < 0 | b ≧ 0 | a < 0 | b < 0 |
| The Second Line | a ≧ 0 | b < 0 | a ≧ 0 | b ≧ 0 |

The capacitive coupling Cp11 is constructed by connecting capacitances C11 and C12 in parallel. It adds the outputs of SEL1 and SEL2. The output of Cp11 is connected to an inverted amplifier INV11 similar to INV4, and an input and output of INV11 are connected by a capacitance C13. The capacitance ratio of C11, C12 and C13 is 1:1:2. Even when an input is substantially the same as Vdd, the output of INV11 is prevented from exceeding Vdd. Assuming the output voltage of the first system of SEL1 and SEL2 are V11 and V21, respectively, and the output of INV11 is V111, the equation in formula (8) is true.

$$V111 = Vdd - \frac{C11V11 + C12V21}{C13} = Vdd - \frac{1}{2}(V11 - V21) \quad (8)$$

The capacitive coupling Cp12 is structured by connecting capacitances C14, C15 and C16 in parallel. An inverted amplifier INV12 and a feedback capacitance C17 are connected to the output. The ratio of the capacitances of C14:C15:C16:C17=1:2:1:4. Even when an input is substantially the same as Vdd, the output of the INV12 is prevented from exceeding the Vdd. The capacitance of C15 is twice as much as C14 and C16 so as to balance with the previous stage. Assuming the output of the second system of SEL1 and SEL2 are V12 and V22, V112 of the output of INV12 satisfies the formula (9).

$$V112 = Vdd - \frac{C14V12 + C15V111 + C16V22}{C17} = Vdd - \frac{1}{4}(V12 + 2V111 + V22) \quad (9)$$

When formula (9) is substituted for formula (8), formula (10) can be obtained.

$$V112 = \frac{1}{2}Vdd + \frac{1}{4}(V11 + V21 - V12 - V22) \quad (10)$$

From TABLE 1, V11, V12, V21 and V22 have the values below.

TABLE 2

| | V11 | V12 | V21 | V22 |
|---|---|---|---|---|
| a ≧ 0 | Vref = 0 | −ax | — | — |
| a < 0 | ax | Vref = 0 | — | — |
| b ≧ 0 | — | — | −by | Vref = 0 |
| b < 0 | — | — | Vref = 0 | by |

When the offset and the magnification are ignored, the output V112 can be expressed by formula (11) regardless the polarities of a and b.

$$V112 = ax - by \quad (11)$$

The formula (11) corresponds to the real part of the multiplication result in formula (5).

The capacitive coupling Cp21 is structured by connecting capacitances C21 and C22 in parallel. It adds the outputs of SEL3 and SEL4. The input and output of INV21 are connected by a feedback capacitance C23. The capacitance ratio of C21, C22 and C23 is 1:1:2. Even when the voltages of x and y are substantially the same as Vdd, the output of NV21 is prevented from exceeding Vdd. Assuming the output voltage of the first lines of SEL3 and SEL4 to be V31 and V41, respectively, and assuming an output of INV121 to be V121, the equation below is true.

$$V121 = Vdd - \frac{C21V31 + C22V41}{C23} = Vdd - \frac{1}{2}(V31 + V41) \quad (12)$$

Capacitive coupling Cp22 is structured by connecting capacitances C24, C25 and C26 in parallel. An inverted amplifier INV22 and a feedback capacitance C27 are connected to its output. The capacitance ratio of C24, C25, C26 and C27 is 1:2:1:4. Even when an input is substantially the same voltage, an output of INV22 is prevented from exceeding Vdd. The capacitance of C25 is twice as large as C24 and C26 so as to balance with the previous stage.

Assuming the output of two lines of SEL3 and SEL4 to be V32 and V42, respectively, V122 of the output of INV22 can be obtained by the formula (13).

$$V122 = Vdd - \frac{C24V32 + C25V121 + C26V42}{C27} = Vdd - \frac{1}{4}(V32 + 2V121 + V42) \quad (13)$$

Substituting the formula (12) for the formula (13), formula (14) can be obtained.

$$V122 = \frac{1}{2}Vdd + \frac{1}{4}(V31 + V41 - V32 - V42) \quad (14)$$

From TABLE 1, V31, V32, V41 and V42 have the following values.

TABLE 3

| | V31 | V32 | V41 | V42 |
|---|---|---|---|---|
| a ≧ 0 | Vref = 0 | ay | — | — |
| a < 0 | −ay | Vref = 0 | — | — |
| b ≧ 0 | — | — | Vref = 0 | bx |
| b < 0 | — | — | −bx | Vref = 0 |

When the offset and the magnification is ignored, the output V122 can be expressed by formula (15) regardless of the polarity of a and b.

$$V112 = bx + ay \quad (15)$$

The formula (15) corresponds to the imaginary part of the formula (5).

Figure 2:
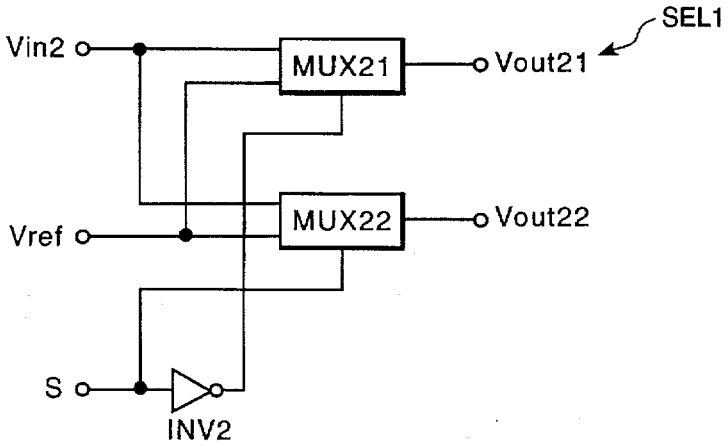
FIG. 2 shows a circuit of a selector of the embodiment.

In FIG. 2, the selector SEL1 includes a pair of multiplexers MUX21 and MUX22. An input voltage Vin2 (an output of MUL1 in FIG. 1) and the reference voltage Vref are applied as inputs to the multiplexers. Each multiplexer selectively inputs Vin2 or the reference voltage Vref, and MUX21 and MUX22 are controlled by a control signal S so as to generate outputs different from each other. The control signal S is applied as an input to MUX22, as well as to MUX21 through an inverter INV2. That is, control signals of opposite logic are applied as an input to MUX22. Consequently, MUX21 and MUTX22 output different signals. The multiplexers are structured by well-known circuits such as controlling a pair of MOS switches by a control signal of opposite logic.

As above, the complex number multiplying circuit can directly multiply a complex number as an analog signal and as a digital signal, and it generates an output in the form of an analog voltage. Therefore, a circuit for A/D and D/A conversion is not necessary. The multiplying circuit is appropriate for analog architecture.

Figure 3:
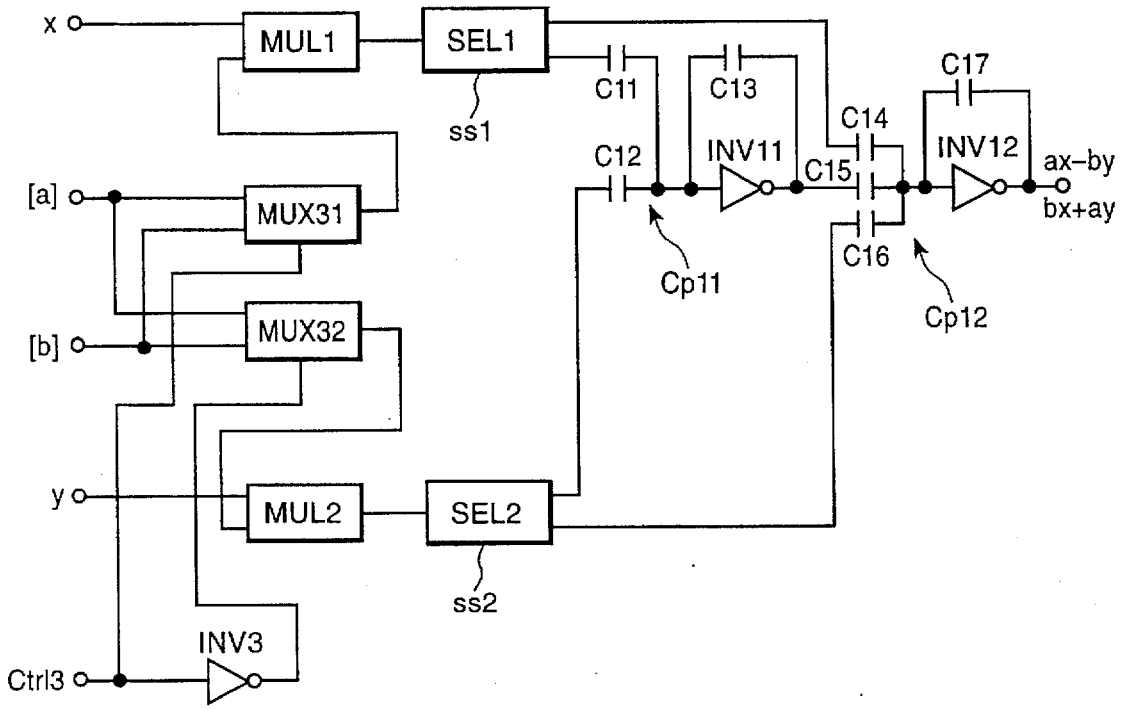
FIG. 3 shows a circuit of the second embodiment.

FIG. 3 shows the second embodiment of the present invention. In the figure, the same or substantially the same parts as in the first embodiment are designated by the same references. In the second embodiment, the multiplication circuits MUL3, MUL4 and addition portions of the circuits on the stages following SEL3 and SEL4 in the first embodiment are omitted and the circuit is simplified. The complex number given by digital signals is separated into the real part and the imaginary part and processed by the individual timing. That is, the real part and the imaginary part can be processed by switching the path in the circuit, which is processed within 1 operation clock.

In FIG. 3, the complex multiplier includes the first and the second multiplication circuits MUL1 and MUL2 similar to the first embodiment. Outputs of MUL1 and MUL2 are applied to selectors SEL1 and SEL2, respectively. With respect to the outputs of SEL1 and SEL2, the output of the first line of SEL1 and SEL2 is applied as an input to the capacitive coupling Cp11, otherwise, the output of the second line is applied as an input to the capacitive coupling Cp12. An output of Cp11 is applied as an input to the inverter INV1. The output of INV11 is applied as an input to Cp12, as well as being connected to the input of INV11 through a feedback capacitance C13. An output of the Cp12 is applied as an input to an INV12 to which a feedback capacitance C17 is connected.

A digital multiplier is applied as an input to the multiplication circuit MUL1 through multiplexer MUX31, and it is applied as an input to the multiplication circuit MUL2 through multiplexer MUX32. Absolute values |a| and |b| are applied as inputs to MUX31 and MUX32. They output one of the multipliers according to a control signal Ctr13. Ctr13 is applied as an input to the MUX31, as well as being applied as an input to the MUX32 through an inverter INV3. Control signals ss1 and ss2 are also applied as inputs to SEL1 and SEL2 in order to select the first line or the second line.

For example, when the real part (ax−by) of the multiplication result is generated, the multipliers of MUL1 and MUL2 are |a| and |b|, respectively. The signal ss1 defines the sign of the multiplier of MUL1 ("a", in this case), and signal ss2 is determined according to the selection of the multiplier of MUL2 ("b", in this case) and the sign of selected multiplier b. −ax is generated on the second line and Vref=0 is generated on the first line when a is designated by ss1 as being positive or 0. ax is generated on the first line and 0 is generated on the second line when a is designated by ss1 as being negative. −by and 0 are generated on the first and second line, respectively, when b is designated by ss2 as being positive or 0. "by" and 0 are generated on the second line and the first line, respectively, when b is designated by ss2 as being negative.

When the imaginary part (bx+ay) of the multiplication result is generated, the multipliers of MUL1 and MUL2 are |b| and |a|, respectively. ss1 is a signal of the multiplier of MUL1 ("b", in this case), and ss2 is a signal determined by the selection of the multiplier of MUL2 ("b", in this case) and the polarity of selected multiplier a. −bx is generated on the second line and Vref=0 is generated on the first line when b is designated by ss1 as being positive or 0. bx is generated on the first line and 0 is generated on the second line when b is designated by ss1 as being negative. −ay and 0 are generated on the second and first line, respectively, when a is designated by ss2 as being positive or 0. "ay" and 0 are generated on the first line and the second, respectively, when a is designated by ss2 as being negative.

The above settlements are shown in TABLE 4.

TABLE 4

| Selection of Multiplier | Line | a ≧ 0 | a < 0 | b ≧ 0 | b < 0 |
|---|---|---|---|---|---|
| Multiplier of MUL1 is "a" | The First Line | 0 | ax | −by | 0 |
| | The Second Line | −ax | 0 | 0 | by |
| Multiplier of MUL1 is "b" | The First Line | 0 | ay | 0 | bx |
| | The Second Line | −ay | 0 | −bx | 0 |

Since the number of addition portions is reduced to one by substitution of a plurality of multipliers, it contributes to a reduction in electric power consumption.

Hereinafter the third embodiment of a circuit for calculating an absolute value of a complex number is described with reference to the attached drawings.

Figure 5:
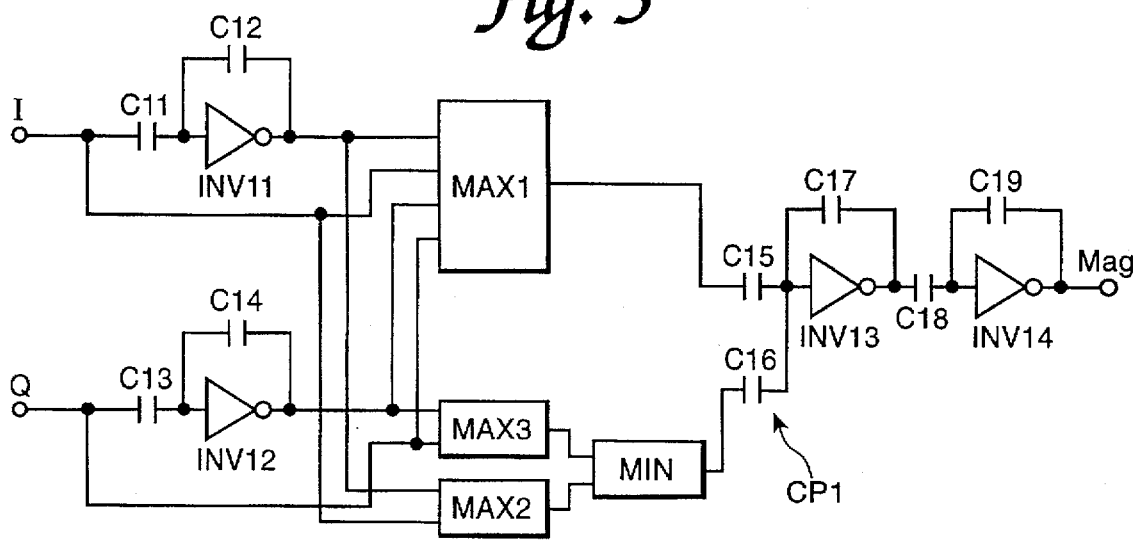
FIG. 5 shows a circuit of the third embodiment of the present invention.
Figure 6:
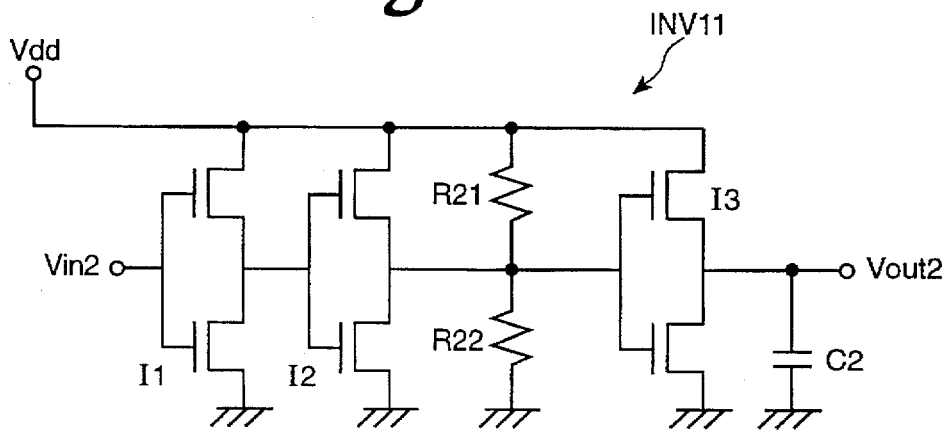
FIG. 6 shows an inverter circuit of the embodiment.

FIG. 5 shows a circuit for operating the formula (16) in the conventional embodiment using an analog processing. The real part I and the imaginary part Q of a signal are connected to a pair of inverter circuits INV11 and INV12. As shown in FIG. 6, in an inverter circuit INV11, odd number of MOS inverters I1, I2 and I3 are serially connected and INV11 has a high gain as a product of gain of each inverter. An input capacitance C11 is connected to an input of INV11. The real part I is connected to INV1 through the capacitance C11. An output of INV11 is applied to its input through a feedback capacitance C12. Assuming an output of INV11 to be Vo11 and a supply voltage to be Vdd, the formula (17) can be obtained. The capacitances of C11 and C12 are equal to each other and Vo11 is an inverse output of I. Because of the high gain of INV11, an output is stable and highly accurate regardless the load.

$$Vo11 = Vdd - \frac{C11}{C12} I = Vdd - I \tag{17}$$

The structure of an inverter circuit INV12 is similar to that of INV11, and the output of Vo12 is an inverted output of Q as in formula (18).

$$Vo12 = Vdd - \frac{C13}{C14} Q = Vdd - Q \tag{18}$$

An input 1 and output Vo11 of the INV11 are applied as an input to the second maximum circuit MAX2, and an input Q and output Vo12 of the INV12 are applied as inputs to the third maximum circuit MAX3. All these inputs and outputs are applied as inputs to the first maximum circuit MAX1. The output of MAX2 and MAX3 are applied as inputs to the minimum circuit MIN.

Figure 7:
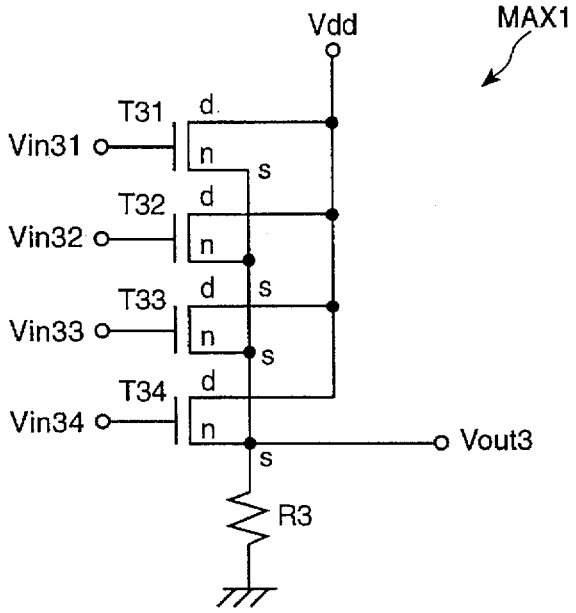
FIG. 7 shows the first maximum circuit of the embodiment.

As in FIG. 7, the maximum circuit MAX1 includes four nMOS (shown by T31, T32, T33 and T34) corresponding to four inputs. Their drains d are connected to a supply voltage Vdd and their sources s are common outputs Vout3. Input voltages Vin31, Vin32, Vin33 and Vin34 are individually connected to a respective gate of each nMOS, and the sources s are grounded through a high resistance R3.

Each nMOS is arranged such that, when a gate voltage is generated at a source and the voltage of one of Vin31 to Vin34 is higher than the others, the source voltage of other nMOS is higher than the gate voltage and cut off and only the maximum voltage is applied as an output Vout3.

Figure 8:
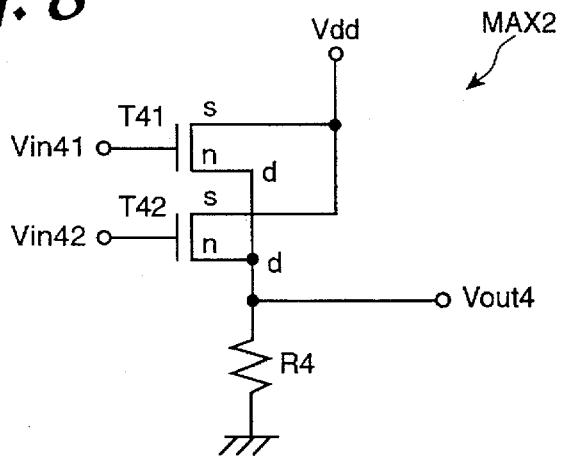
FIG. 8 shows the second maximum circuit of the embodiment.

In FIG. 8, the second maximum circuit MAX2 is structured by circuits similar to MAX1 with two inputs. The drains of two nMOSs of T41 and T42 are connected to the Vdd and the sources are connected to a grounded resistance R4, as well as to a common output Vout4.

Figure 9:
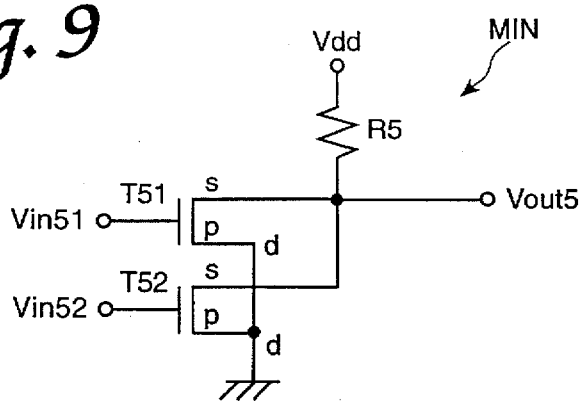
FIG. 9 shows a minimum circuit of the embodiment.

In FIG. 9, a minimum circuit MIN includes two pMOS T51 and T52. Their sources s are connected to the supply voltage Vdd through a high resistance R5, and a common output Vout5. Input voltages Vin51 and Vin52 are connected to the gates of each pMOS, and a drain d is grounded.

Each pMOS is arranged such that, when a gate voltage is generated at a source and either of Vin41 and Vin52 is lower than the other, the source voltage of the higher pMOS is lower than the gate voltage and cut off and only the minimum voltage is applied as an output Vout5.

Outputs of MAX1 and MIN are connected to capacitances C15 and C16 of capacitive coupling CP1, and an output of CP1 is applied as an input to an inverter circuit INV13. The INV13 is structured similar to INV11, and an output of it is connected to its input through a feedback capacitance C17. Assuming an output of MAX1 is Vo13, an output of MIN is Vo14 and an output of INV13 is Vo15, formula (19) can be obtained. Here, the capacitance ratio is C15:C16:C17=2:1:1.

$$Vo15 = \frac{5}{4} Vdd - \frac{C15Vo13 + C16Vo14}{C17} = \frac{5}{4} Vdd - \frac{2Vo13 + Vo14}{2} \tag{19}$$

An inverter INV14 is connected to an output of INV13 through a capacitance C18. An output of INV14 is connected to its input through a feedback capacitance C19. The capacitances of C18 and C19 are equal to each other. Here taking the formula (19) into consideration, the final output Mag is settled as in formula (20).

$$\text{Mag} = Vdd - Vo15 = Vo13 + \frac{1}{2}\ Vo14 - \frac{1}{4}\ Vdd \tag{20}$$

−Vdd/4 in the formula (20) is an offset voltage. It can be easily deleted by impressing a voltage for canceling it parallelly to the output of INV13 through a capacitance. Considering the formula (17) and (18), and the characteristics of MAX1, MAX2, MAX3 and MIN, and when an offset voltage is canceled, the formula (20) can be transformed as in formula (21).

$$\text{Mag} = \text{Max}\{I, Q, (Vdd - I), (Vdd - Q)\} + \frac{1}{2}\ \text{Min}\{\text{Max}\{I, (Vdd - I)\}, \text{Max}\{Q, (Vdd - Q)\}\} \tag{21}$$

In order to maximize the negative and positive ranges, the numerical 0 is preferably represented by the voltage Vdd/2. In this case, the maximum operation is equivalent to the absolute value operation. Therefore, formula (21) can be rewritten into formula (22).

$$\text{Mag} = \text{Max}\{\text{Abs}(I), \text{Abs}(Q)\} + \frac{1}{2}\ \text{Min}\{\text{Abs}(I), \text{Abs}(Q)\} \tag{22}$$

This is the same as the formula (16). It means that the conventional operation is realized by an analog system.

Again in FIG. 6, in the inverter circuit INV11 (INV12, INV13 and INV14 have the same structure), a capacitance C2 is connected to the end of the output as a low-pass filter, and a balancing resistance including resistances R21 and R22 is connected to an output of the second stage inverter 12. One terminal of R21 is connected to I2 and another terminal is connected to the supply voltage Vdd. One terminal of R22 is connected to I2 and another terminal is grounded. The balancing resistance lowers a gain of the inverter circuit, and the capacitance cancels a component of a high frequency. Consequently, unusable oscillation is prevented, which may occur in the feedback system of the feedback capacitance.

Figure 10:
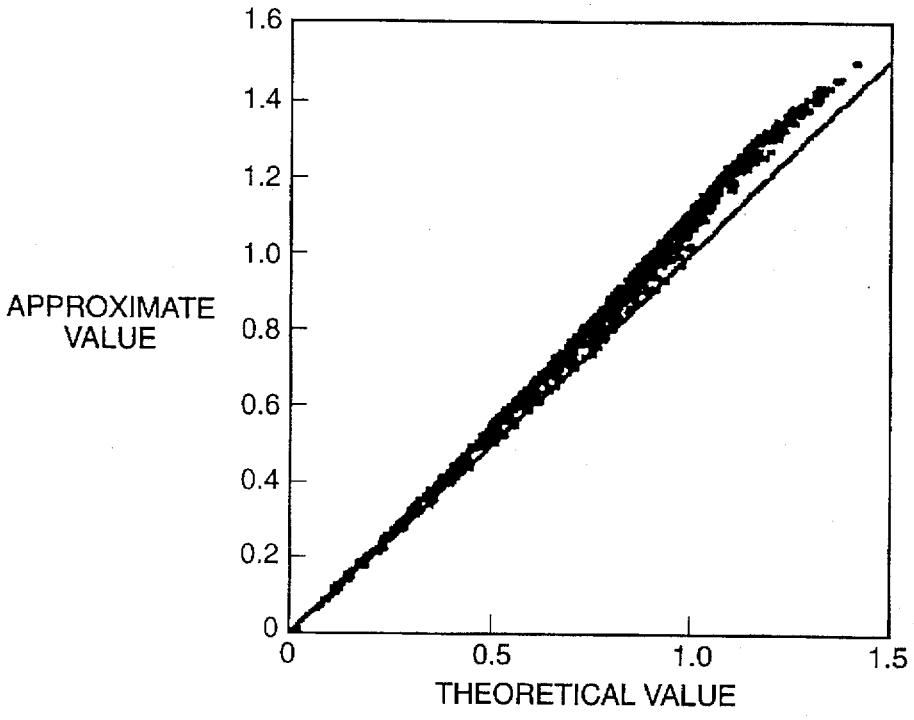
FIG. 10 shows a graph of the operation result of the embodiment.

An output of the circuit above is simulated by simulation software and the data in FIG. 10 is obtained. In FIG. 10, the horizontal axis shows the theoretical values of outputs in response to various inputs (approximately 1,000 inputs). And the vertical axis shows the simulated data by approximation. The relationship between theoretical values and the approximate values is shown by plots. The identifications of the theoretical and approximate values are also shown by a solid line as an ideal line. As the plot is close to the ideal line, the approximate value has high quality. The result of FIG. 10 shows the performance of conventional formula (16). It is confirmed that such a superior approximate value can be calculated by the third embodiment.

As above, the approximation formula of the formula (16) has a good performance. According to the inventors' research, further higher accuracy of an approximate value can be obtained when the capacitance ratio of the capacitances is C15:C16:C17=10:5:11. It is a variation of the first embodiment.

$$\text{Mag}\ \frac{10}{11}\ \text{Max}\{\text{Abs}(I), \text{Abs}(Q)\} + \frac{5}{11}\ \text{Min}\{\text{Abs}(I), \text{Abs}(Q)\} \tag{23}$$

Figure 11:
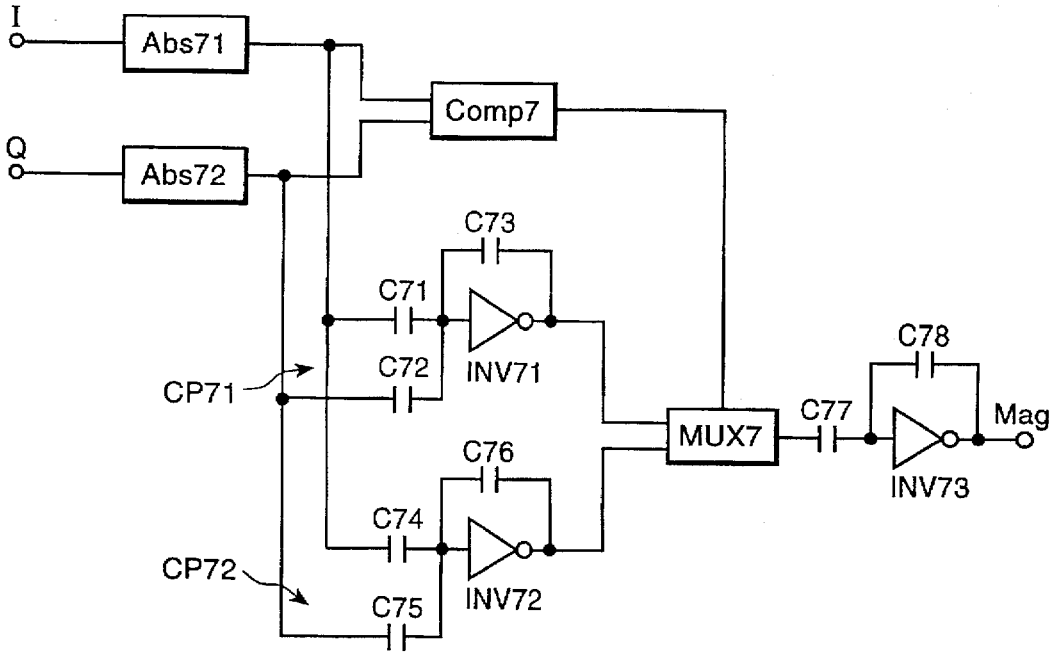
FIG. 11 shows the circuit of the fourth embodiment.

FIG. 11 shows the fourth embodiment of the present invention. It realizes the conventional formula (16) similar to the third embodiment. The present embodiment consists of the first and the second absolute circuits of Abs71 and Abs72. Outputs from those circuits are integrated by the first and the second capacitive couplings CP71 and CP72. The capacitive coupling CP71 consists of capacitances C71 and C72, and outputs of Abs71 and Abs72 are connected to C71 and C72, respectively. The capacitive coupling CP72 includes capacitances C74 and C75, and outputs of Abs71 and Abs72 are connected to C74 and C75, respectively. An output of CP71 is applied as an input to an inverter circuit INV71 which is similar to the inverter circuit in FIG. 6, and an output of CP72 is connected to an inverter circuit INV72. Outputs of inverter circuits INV71 and INV72 are connected to its inputs by feedback capacitances C73 and C76, respectively. The capacitance ratio above is as below.

$$C71:C72:C73=2:1:2 \tag{24}$$

$$C74:C75:C76=1:2:2 \tag{25}$$

Therefore, assuming outputs of INV71 and INV72 to be Vo71 and Vo72, the formulas below can be obtained.

$$Vo71 = \frac{5}{4}\ Vdd - \frac{C71\ \text{Abs}(i) + C72\ \text{Abs}(Q)}{C73} = \frac{5}{4}\ Vdd - \left\{ \text{Abs}(I) + \frac{1}{2}\ \text{Abs}(Q) \right\} \tag{26}$$

$$Vo72 = \frac{5}{4}\ Vdd - \frac{C74\ \text{Abs}(i) + C75\ \text{Abs}(Q)}{C76} = \frac{5}{4}\ Vdd - \left\{ \frac{1}{2}\ \text{Abs}(I) + \text{Abs}(Q) \right\} \tag{27}$$

Figure 13:
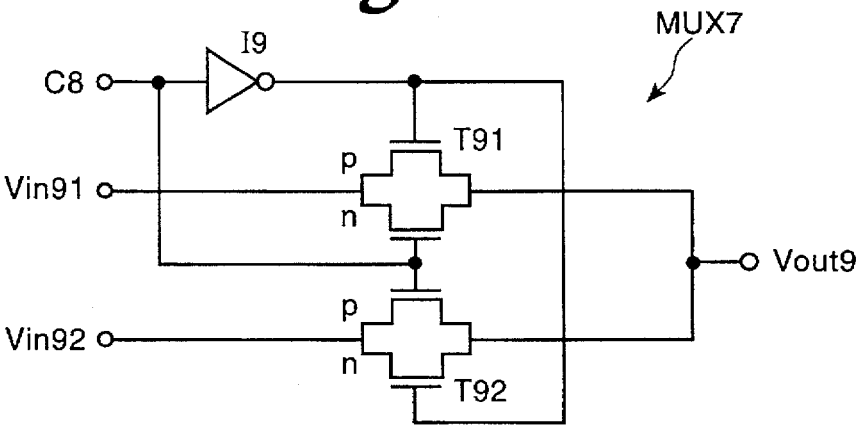
FIG. 13 shows a multiplexer of the embodiment.
Figure 14:
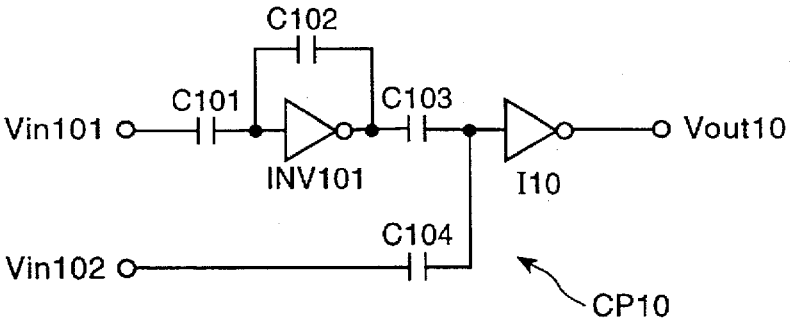
FIG. 14 shows a comparison circuit of the embodiment.

An output of the absolute value circuit above is input to a comparison circuit Comp7. It outputs a signal which is larger between Abs(I) and Abs(Q). The signals are shown in FIG. 13 and FIG. 14 as C8 and Vout10, respectively. Outputs of INV71 and INV72 are applied as inputs to a multiplexer MUX7. They control MUX7 so that MUX7 outputs Vo71 when Abs(I)≧Abs(Q) and outputs Vo72 when when Abs(I) <Abs(Q).

An output of MUX7 is applied as an input to an inverter INV73 through a capacitance C77. An output of INV73 is connected to its input through a capacitance C78. C77 and C78 are set to have the same capacitance, and an output inverted value of the formulas (26) and (27) are generated as the final output Mag.

That is, the final output Mag is as below.

When Abs(I)≧Abs(Q), $$\text{Mag} = Vdd - Vo71 = \text{Abs}(I) + \frac{1}{2\text{Abs}}\ (Q) - \frac{1}{4}\ Vdd \tag{28}$$

When Abs(I)<Abs(Q), $$\text{Mag} = Vdd - Vo72 = \frac{1}{2}\ \text{Abs}(I) + \text{Abs}(Q) - \frac{1}{4}\ Vdd \tag{29}$$

They are equivalent to the formula (16). The offset voltage −Vdd/4 can be easily canceled in a similar manner as above.

Figure 12:
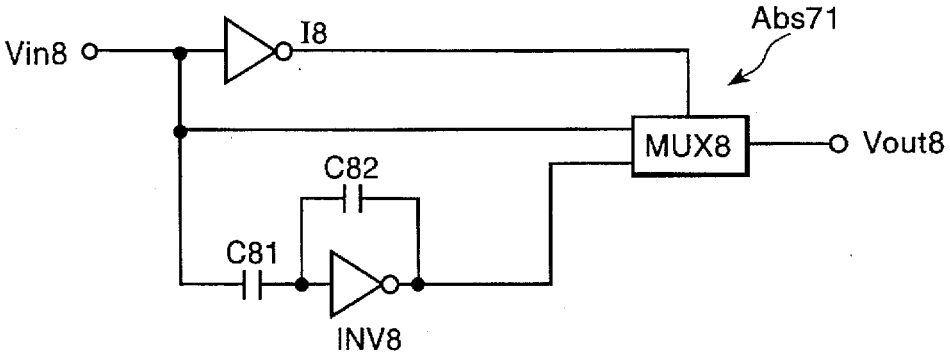
FIG. 12 shows the first maximum circuit of the embodiment.

In FIG. 12, the absolute value circuit Abs71 consists of a MOS inverter 18 (similar to I1 to I3 in FIG. 6) for judging whether an input voltage Vin8 (corresponding to the I in FIG. 11) exceeds the threshold (Vdd/2). I8 outputs Vdd when Vin8 is equal to or below the threshold, and is inverted into 0[V] when Vin8 exceeds the threshold.

Vin8 is input to an inverter circuit INV8 similar to the above through a capacitance C81. An output of Inv8 is connected to its input through feedback capacitance C82. The capacitances of C81 and C82 are the same, and the inverter circuit INV8 stably and highly accurately generates an inverted output of Vin8. Vin8 and the inverse output are applied as inputs to the multiplexer MUX8. MUX8 is switched in response to the output of I8. MUX8 outputs Vin8 when Vin8≧Vdd/2, and outputs an inverse output of (Vdd−Vin8) when Vin8≦Vdd/2.

In FIG. 13, MUX7 consists of a pair of switches T91 and T92 to which input voltages Vin91 and Vin92 are connected, respectively. With respect to a MOS switch T91, C8 of a gate control signal of nMOS is inverted by an inverter 19 and applied as an input to a gate of pMOS. With respect to T92, C8 is applied as an input to a gate of pMOS, and its inverse is applied as an input to a gate of nMOS. That is, T91 and T92 are alternatively closed and one of Vin91 and Vin92 is output as an output Vout9.

In FIG. 14, Comp7 consists of a capacitive coupling CP10 including capacitances C103 and C104. An inverter circuit INV101 is connected to C103. The first input Vin101 is applied as an input to INV101 through capacitance C101. An output of INV101 is connected to its input through a feedback capacitance C102. An inverse output of Vin101 is impressed on C103 by setting the capacitances to be C101=C102. Here, the capacitances of C103 and C104 are equal to each other, and output Vo10 of CP10 is as in formula (30).

$$Vo10=\frac{1}{2}\ Vdd+\frac{Vin102-Vin101}{2} \tag{30}$$

An output of the formula (30) is applied as an input to a MOS inverter I10. According to the polarity of the second term of the formula (30), Vo10 is equal to, more or less than Vdd/2. The inverter I10 has the threshold of Vdd/2, and it outputs Vdd or 0[V] as an output Vout10 according to which of V101 and V102 is larger than the other.

Figure 16:
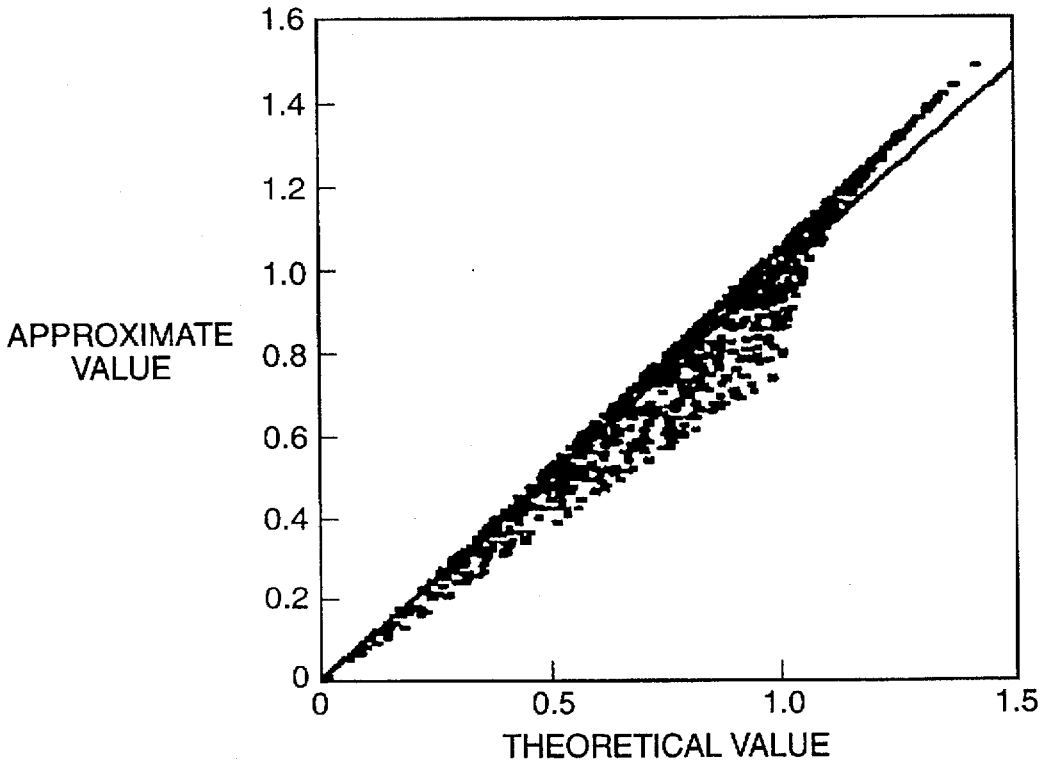
FIG. 16 show a graph of the operation result of the embodiment.

The operation result of the fourth embodiment above is the same as in FIG. 10, and the approximation operation in FIG. 16 can be realized in an analog method. Similar to the variation of the third embodiment, it is easy to realize the circuit for the operation of formula (23). That is, it is carried out by setting the capacitance ratio below with respect to the capacitances C71, C72, C73, C74, C75 and C76.

$$C71:C72:C73=10:5:11 \tag{31}$$

$$C74:C75:C76=5:10:11 \tag{32}$$

In the communication field, there are a lot of cases where a correlative peak within a received signal and a spread peak are calculated and that it is judged whether the peaks exceed a predetermined level. In such a case, the area in which the absolute value of a complex number is at a low level has low importance. Therefore, in the fifth embodiment, the inventors have developed the simplified approximation formula (33) by sacrificing the accuracy of the approximation in the area of the low level.

$$Mag=\frac{3}{4}\ \{Abs(I)+Abs(Q)\} \tag{33}$$

The operation result by the formula (33) is shown in FIG. 16. It is sufficiently accurate with respect to the value equal to and more than 1.

Figure 15:
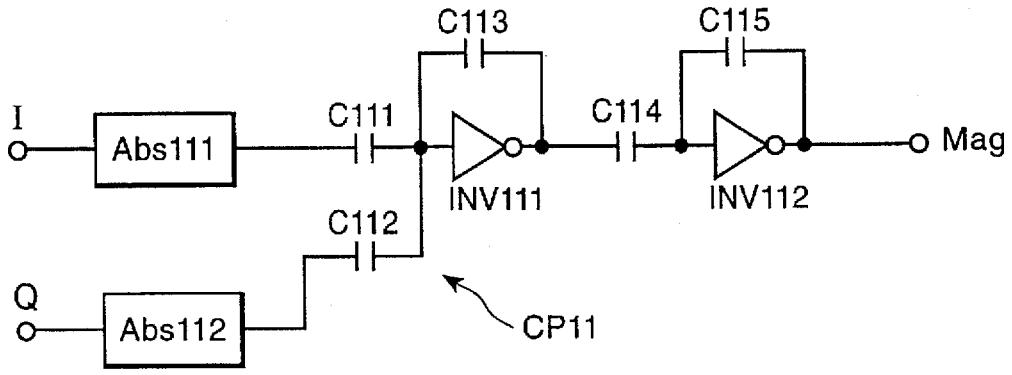
FIG. 15 shows the circuit of the fifth embodiment.

FIG. 15 is a circuit for operating the formula (33) using an analog system. The first and the second absolute value circuits Abs111 and Abs112 are connected to capacitances C111 and C112 of the capacitive coupling CP11. An output of CP11 is connected to an inverter INV111 similar to that which is shown in FIG. 6, and an output INV111 is connected to its input through a feedback capacitance C113. The capacitance ratio of C111, C112 and C113 is $$C111:C112:C113=3:3:4 \tag{34}$$

Vo111 of an output of the INV111 is expressed by the formula (35).

$$Vo111=\frac{5}{4}\ Vdd-\frac{3}{4}\ \{Abs(I)+Abs(Q)\} \tag{35}$$

An output of INV111 is connected to an inverter circuit INV112 through a capacitance C114, and an output of INV112 is connected to its input through a capacitance C115. The inverter circuit is the one for inverting similar to INV14, INV73 and so on. The capacitance ratio is C114=C115. Therefore, the final output Mag when an offset voltage is canceled is expressed in the formula (33).

It is possible to prevent a wrong judgment of recognizing an operation result to be below the predetermined level by giving an offset to the operation result of the formula (33). The offset can be various ones according to the characteristic of a received signal. Assuming the offset to be α, the formula (33) can be transformed as in a formula (36). This is the sixth embodiment.

$$Mag=\frac{3}{4}\ \{Abs(I)+Abs(Q)\}+\alpha \tag{36}$$

Figure 18:
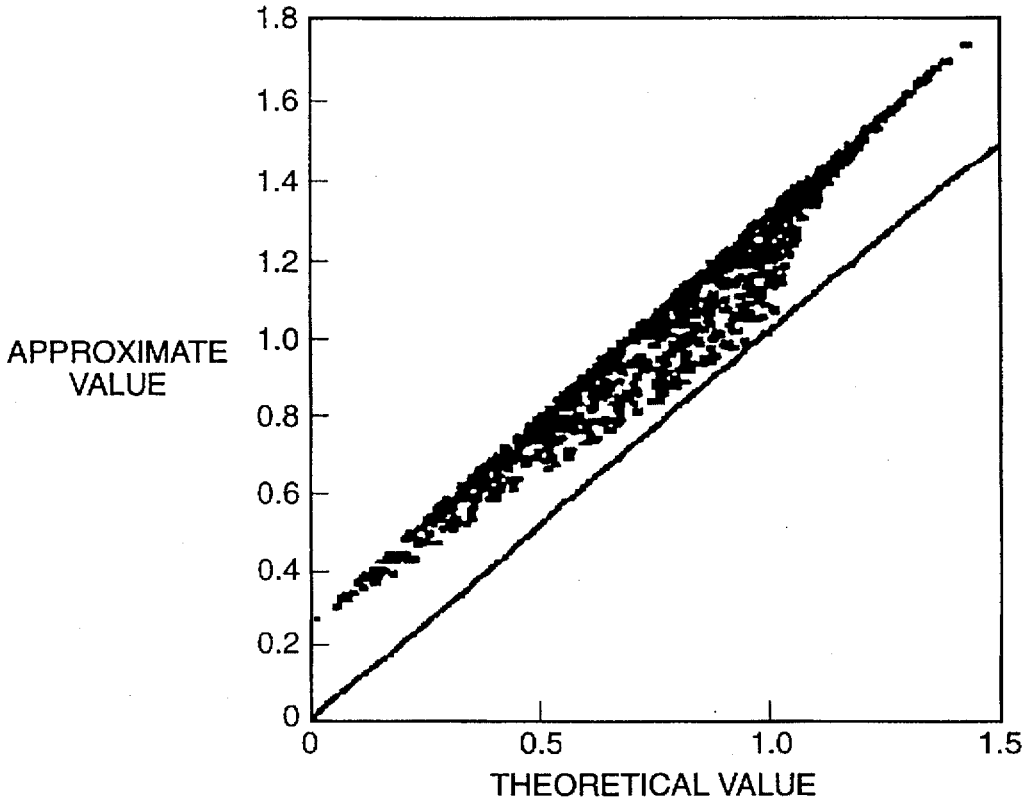
FIG. 18 shows a graph of the first operation result of the embodiment.
Figure 19:
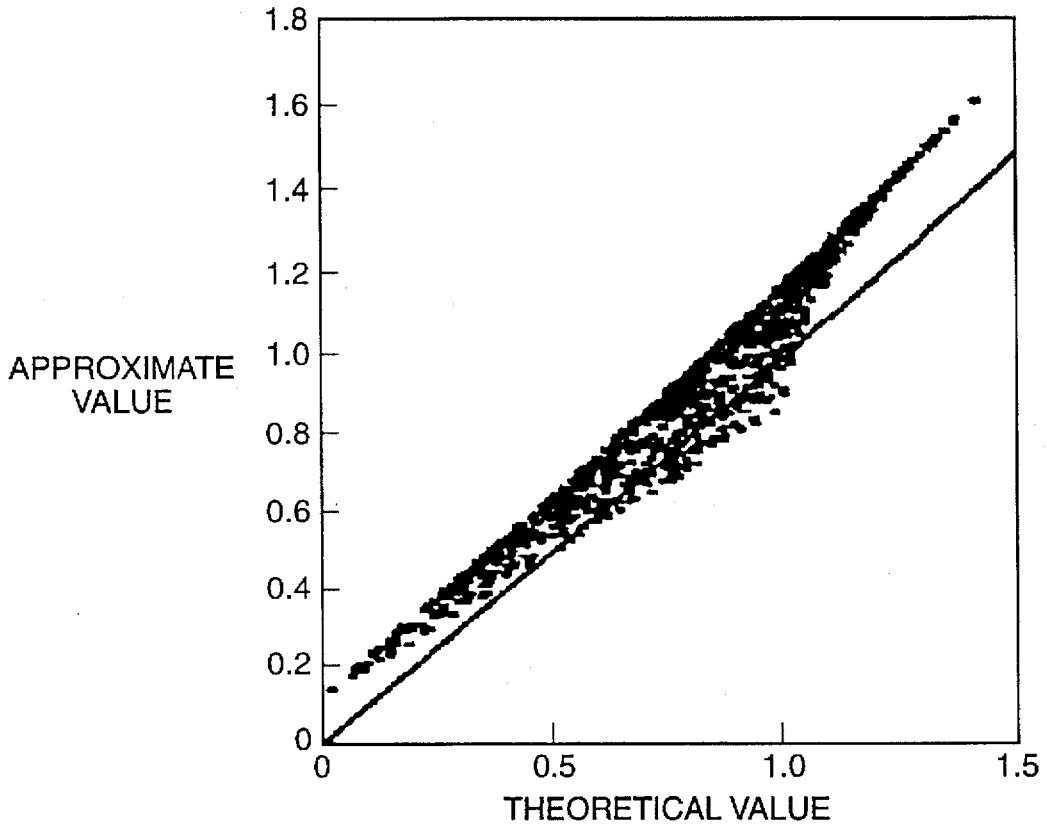
FIG. 19 shows a graph of the second operation result of the embodiment.

Generally, good results are obtained when α is constant times as large as Vdd of a voltage of a peak-to-peak of an input signal, for example, α=0.250Vpp or α=0.125Vpp. The results of the operations are in FIG. 18 (α=0.250Vpp) and in FIG. 19 (α=0.125Vpp). All the approximate values are larger than the theoretical values in FIG. 18, and most of the approximate values are larger (a part of them are lower) than the theoretical value in FIG. 19.

Figure 17:
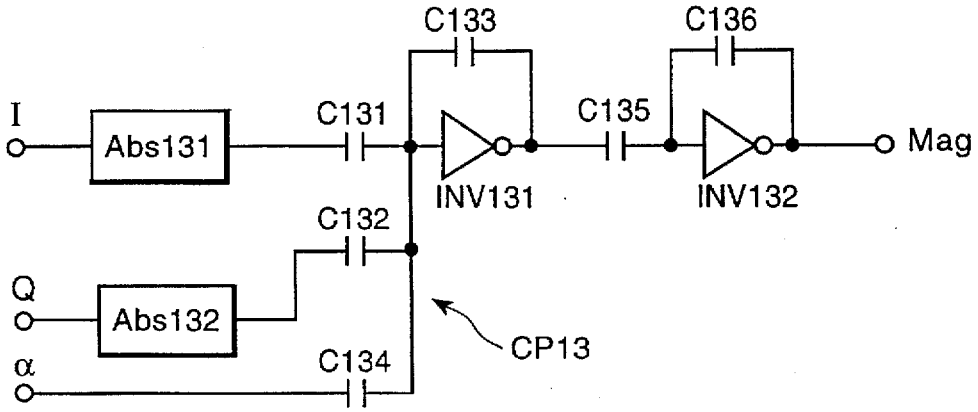
FIG. 17 shows the circuit of the sixth embodiment.

FIG. 17 is a circuit for realizing the formula (36). A capacitance is added to the capacitive coupling in the circuit in FIG. 15 so as to apply an offset. In FIG. 17, absolute value circuit Abs131 and Abs132 for inputting I and Q are connected to capacitances C131 and C132 of capacitances of a capacitive coupling CP13, and an offset voltage α is connected to a capacitance C134 which is added to the capacitive coupling. An inverter circuit INV131 is connected to an output of CP13, and an output of INV131 is connected to its input through a capacitance C133. An output of INV131 is connected to an inverter INV132 through a capacitance C135, and an output of INV132 is connected to its input through a capacitance C136.

Here, $$C131:C132:C133:C134=3:3:4:4 \tag{37}$$

$$C135:C136=1:1 \tag{38}$$

When an offset voltage is canceled, it is clear that the formula (36) is realized.

Figure 20:
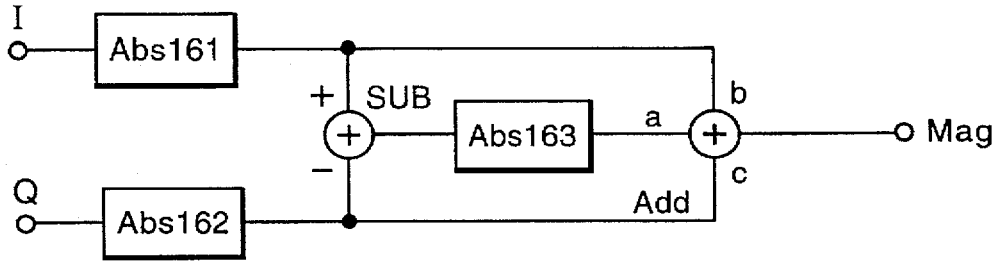
FIG. 20 shows the circuit of the seventh embodiment.

FIG. 20 shows the seventh embodiment. Outputs of the first and the second absolute value circuit Abs161 and Abs162 to which I and Q are connected, respectively, are connected to a subtraction circuit SUB. The SUB substitutes the output of Abs162 from the output of Abs161. The output of SUB is applied as an input to the third absolute value circuit Abs163. An output of Abs163 is applied as an input to a weighted addition circuit Add with outputs of Abs161 and Abs162. Add multiplies the multipliers a, b and c to outputs of Abs163, Abs161 and Abs162 and adds them. As above, Mag of the final output of Add is expressed by a formula (39)

$$Mag=b\cdot Abs(I)+c\cdot Abs(Q)+a\cdot Abs(Abs(I)-Abs(Q)) \tag{39}$$

Assuming that a=¼, b=c=¾, the formula (39) is an approximation formula equivalent to the formula (16). The circuit in FIG. 20 can be constructed only by some absolute value circuits, addition circuits and subtraction circuits. The components are simple and the high accuracy of each circuit can be easily obtained with sureness.

Figure 21:
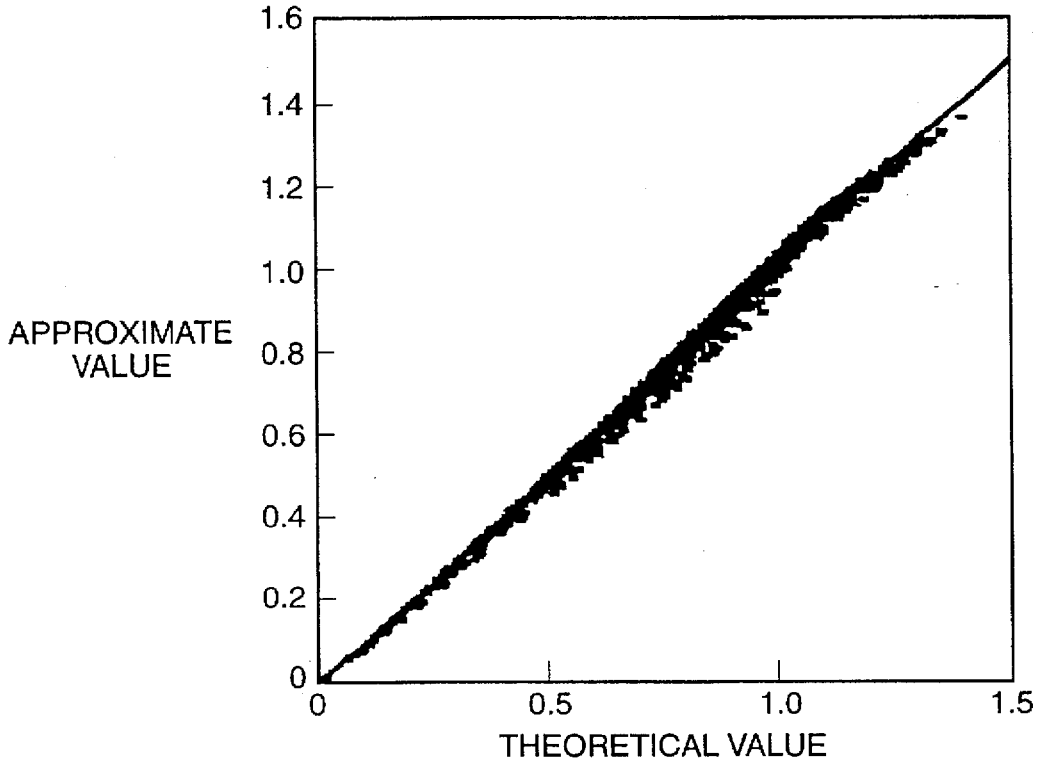
FIG. 21 shows a graph of the operation result of the embodiment.

The whole of the accuracy becomes higher by improving the values of a, b and c. The operation results in FIG. 21 can be obtained by setting a=5/22, b=15/22 and c=15/22. It is more accurate than the operation results in the formula (16) in the total area.

Figure 22:
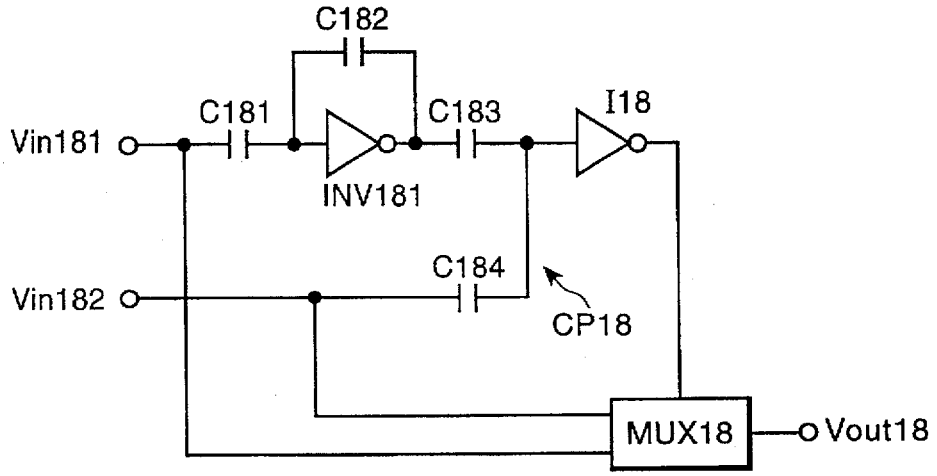
FIG. 22 shows a circuit of an example of a transformation of the maximum and minimum circuits.

The maximum value circuit and the minimum value circuit can be replaced with other circuits. For example, in FIG. 22, input voltage Vin181 and Vin182 are connected to a multiplexer MUX18, and Vin182 and an inverse of Vin181 are added by a capacitive coupling CP18. An output of CP18 is judged to determine whether it exceeds Vdd/2 or not by MOS inverter I18. The structures of the inverter circuit INV181 for inverting Vin181, an input capacitance C181, a feedback capacitance C182, a capacitive coupling CP18 and a MOS inverter I18 are similar to that of the comparison circuit Comp7 (FIG. 14). An output of I18 is Vdd or 0[V] according to the polarity of (Vin182–Vin181).

The multiplexer outputs V181 and V182 according to an output of I18, and a maximum circuit or a minimum circuit is realized by the arrangement of MUX18. That is, when the connection of an input of the circuit in FIG. 13 is properly switched, both of the maximum and minimum values can be set according to the connection of CP18. The yield and accuracy of a circuit can be improved by unifying the components of a circuit.

As above, in a complex number multiplication circuit according to the present invention, a capacitive coupling is used wherein a plurality of capacitances corresponding to weights of bits of a digital multiplier are arranged in parallel, and a digital multiplier is multiplied by the complex number given by an analog voltage. The path is switched according to the polarities of the real part or imaginary part and one or two inverted amplifiers are passed, as well as the multiplication results are added by the capacitive coupling. It is possible to directly multiply a complex number given by an analog signal and the operation results can be obtained as an analog voltage by the complex number multiplication circuit according to the present invention.

It is possible to calculate a conventional approximate formula and an improved formula using i) a first inverter circuit to which a first input voltage corresponding to a real part of a complex number is connected;

ii) a second inverter circuit to which a second voltage corresponding to an imaginary part of the complex number is connected;

iii) a first maximum circuit to which the first and second voltages and outputs of the first and second inverter circuits are connected;

iv) a second maximum circuit to which the first voltage and the output of the first inverter circuit are connected;

v) a third maximum circuit to which the second voltage and the output of the second inverter circuit are connected;

vi) a minimum circuit to which outputs of the second and third maximum circuits are connected;

vii) a capacitive coupling with a plurality of capacitances connected at outputs thereof with one another, to which an output of the minimum circuit and an output of the first maximum circuit are connected so that the outputs of the minimum circuit and the first maximum circuit are weighted by a ratio of 1:2;

viii) a third inverter circuit to which an output of the capacitive coupling is connected; and ix) a fourth inverter circuit to which an output of the third inverter circuit is connected.

of a complex number calculation circuit for calculating an absolute value according to the present invention. Therefore, it is possible to realize a circuit calculating an absolute value suitable for an analog architecture.

What is claimed is:

1. A complex number calculation circuit for multiplication comprising:

i) a first multiplying circuit which comprises;

a) a first capacitive coupling to which an analog voltage is inputted corresponding to a real part of a first complex number and a digital signal is inputted corresponding to an absolute value of a real part of a second complex number, in which capacitances corresponding to a weight of each bit of said digital signal are connected in parallel, b) a plurality of first multiplexers for alternatively connecting said analog voltage or a reference voltage to each said capacitance according to a value of each bit of said digital signal in said first capacitive coupling; and c) a first inverting amplifier with a linear relationship between an input and an output thereof, to which an output of said first capacitive coupling is inputted;

ii) a second multiplying circuit which comprises;

a) a second capacitive coupling to which an analog voltage is inputted corresponding to an imaginary part of said first complex number and a digital signal is inputted corresponding to an absolute value of an imaginary part of said second complex number, in which capacitances corresponding to a weight of each bit of said digital signal are connected in parallel, b) a plurality of second multiplexers for alternatively connecting said analog voltage or said reference voltage to each said capacitance according to said value of each bit of said digital signal in said second capacitive coupling; and c) a second inverting amplifier with a linear relationship between an input and an output thereof, to which an output of said second capacitive coupling is inputted;

iii) a third multiplying circuit which comprises;

a) a third capacitive coupling to which an analog voltage is inputted corresponding to an imaginary part of said first complex number and said digital signal corresponding to said absolute value of said real part of said second complex number, in which capacitances corresponding to a weight of each bit of said digital signal are connected in parallel, b) a plurality of third multiplexers for alternatively connecting said analog voltage or said reference voltage to each said capacitance according to said value of each bit of said digital signal in said third capacitive coupling; and c) a third inverting amplifier with a linear relationship between an input and an output thereof, to which an output of said third capacitive coupling is inputted;

iv) a fourth multiplying circuit which comprises;

a) a fourth capacitive coupling to which an analog voltage is inputted corresponding to said real part of said first complex number and said digital signal is inputted corresponding to said absolute value of said imaginary part of said second complex number, in which capacitances corresponding to said weight of each bit of said digital signal are connected in parallel, b) a plurality of fourth multiplexers for alternatively connecting said analog voltage or said reference voltage to each capacitance according to said value of each bit of said digital signal in said first capacitive coupling; and c) a fourth inverting amplifier with a linear relationship between an input and an output thereof, to which an output of said fourth capacitive coupling is inputted;

v) a first selector connected to an output of said first multiplying circuit; to which a first control signal is inputted for introducing said output of said first multiplying circuit to a first or second output in response to a polarity of said real part of said second complex number, vi) a second selector connected to an output of said second multiplying circuit, to which a second control signal is inputted for introducing said output of said second multiplying circuit to a first or second output in response to a polarity of said imaginary part of said second complex number, vii) a third selector connected to an output of said third multiplying circuit, to which a third control signal is inputted for introducing said output of said third multiplying circuit to a first or second output in response to a polarity of said real part of said second complex number, viii) a fourth selector connected to an output of said fourth multiplying circuit, to which a fourth control signal is inputted for introducing said output of said fourth multiplying circuit to a first or second output in response to a polarity of said imaginary part of said second complex number, ix) a first addition and subtraction portion which comprises, a) a fifth capacitive coupling to which said second output of said first selector and said first output of said second selector are inputted, b) a fifth inverting amplifier with a linear relationship between an input and an output thereof, to which an output of said fifth capacitive coupling is inputted, c) a sixth capacitive coupling to which an output of said first output of said first selector, said second output of said second selector, and an output of said fifth inverting amplifier are inputted;

d) a sixth inverting amplifier with a linear relationship between an input and output thereof, to which an output of said sixth capacitive coupling is connected;

x) a second addition and subtraction portion which comprises, a) a seventh capacitive coupling to which said second output of said third selector and said second output of said fourth selector are inputted, b) a seventh inverting amplifier with a linear relationship between an input and an output thereof, to which an output of said seventh capacitive coupling is inputted, c) an eighth capacitive coupling to which an output of said first output of said third selector, said first output of said fourth selector, and an output of said seventh inverting amplifier are inputted, d) an eighth inverting amplifier with a linear relationship between an input and output thereof, to which an output of said eighth capacitive coupling is connected.

2. A complex number calculation circuit for multiplication comprising:

i) a first multiplying circuit which comprises;

a) a first capacitive coupling to which an analog voltage is inputted corresponding to a real part of a first complex number and a digital signal is inputted corresponding to an absolute value of a real part or an imaginary part of a second complex number, in which capacitances corresponding to a weight of each bit of said digital signal are connected in parallel, b) a plurality of first multiplexers for alternatively connecting said analog voltage or a reference voltage to each said capacitance according to a value of each bit of said digital signal in said first capacitive coupling; and c) a first inverting amplifier with a linear relationship between an input and an output thereof, to which an output of said first capacitive coupling is inputted;

ii) a second multiplying circuit which comprises;

a) a second capacitive coupling to which an analog voltage is inputted corresponding to an imaginary part of said first complex number and a digital signal is inputted corresponding to an absolute value of a real part or an imaginary part of said second complex number, in which capacitances corresponding to a weight of each bit of said digital signal are connected in parallel, b) a plurality of second multiplexers for alternatively connecting said analog voltage or said reference voltage to each said capacitance according to said value of each bit of said digital signal in said second capacitive coupling; and c) a second inverting amplifier with a linear relationship between an input and an output thereof, to which an output of said second capacitive coupling is inputted;

iii) a third multiplexer to which digital signals are applied corresponding to an absolute value of a real part of said second complex number and corresponding to an absolute value of an imaginary part of a second complex number, and a first control signal for selecting between a first state and a second state, in said first state said absolute value of said real part being inputted to said first multiplication circuit, in said second state said absolute value of the imaginary part being inputted to said first multiplication circuit;

iv) a fourth multiplexer to which digital signals are applied corresponding to said absolute value of said real part of said second complex number and corresponding to said absolute value of said imaginary part of said second complex number, and said first control signal for selecting between a first and a second state, in said first state said absolute value of the imaginary part being inputted to said second multiplication circuit, in said second state said absolute value of the real part being inputted to said second multiplication circuit;

v) a first selector connected to an output of said first multiplication circuit to which a second control signal is inputted for introducing said output of said first multiplying circuit to a first output when said real part or said imaginary part is negative and to a second output when positive;

vi) a second selector connected to an output of said second multiplying circuit, to which a third control signal corresponding to a polarity of said real part or imaginary part of said second complex number and corresponding to said first or second state of said third or fourth multiplexer, said output of said second multiplying circuit being introduced to a first output when said third and fourth multiplexers are in said first state and said imaginary part of said second complex number is positive, said output of said second multiplying circuit being introduced to a first output when said third and fourth multiplexers are in said first state, and said imaginary part of said second complex number is positive, said output of said second multiplying circuit being introduced to a second output when said third and fourth multiplexers are in said first state and said imaginary part of said second complex number is negative, said output of said second multiplying circuit being introduced to said second output when said third and fourth multiplexers are in said second state and said real part of said second complex number is positive, said output of said second multiplying circuit being introduced to a first output when said third and fourth multiplexers are in said second state and said real part of said second complex number is negative;

vii) an addition and subtraction portion which comprises;

a) a third capacitive coupling to which an output of said first outputs of said first and second selectors are connected, b) a third inverting amplifier with a linear relationship between an input and output thereof, to which an output of said third capacitive coupling is connected, c) a fourth capacitive coupling to which outputs of said second outputs of said first and second selectors and an output of said third inverting amplifier are inputted, and d) a fifth inverting amplifier with a linear relationship between an input and output thereof, to which an output of said fourth capacitive coupling is connected;

wherein said first and second states of said third and fourth multiplexers are obtained by switching said first control signal in one operation clock.

3. A complex number calculation circuit for calculating an absolute value comprising;

i) a first inverter circuit to which a first input voltage corresponding to a real part of a complex number is connected;

ii) a second inverter circuit to which a second voltage corresponding to an imaginary part of said complex number is connected;

iii) a first maximum circuit to which said first and second voltages and outputs of said first and second inverter circuits are connected;

iv) a second maximum circuit to which said first voltage and said output of said first inverter circuit are connected;

v) a third maximum circuit to which said second voltage and said output of said second inverter circuit are connected;

vi) a minimum circuit to which outputs of said second and third maximum circuits are connected;

vii) a capacitive coupling with a plurality of capacitances connected at outputs thereof with one another, to which an output of said minimum circuit and an output of said first maximum circuit are connected so that said outputs of said minimum circuit and said first maximum circuit are weighted by a ratio of 1:2;

viii) a third inverter circuit to which an output of said capacitive coupling is connected; and iv) a fourth ilnverter circuit to which an output of said third inverter circuit is connected.

4. A complex number calculation circuit as claimed in claim 3 wherein:

i) said first inverter circuit comprises;

a) an inverter comprising an odd number of serial MOS inverters, b) an input capacitance connected between an input of said inverter and said first input voltage, and c) a feedback capacitance having the same capacitance as said input capacitance, for connecting an output of said inverter to its input;

ii) said fourth inverter circuit comprises;

a) an inverter comprising an odd number of serial MOS inverters, b) an input capacitance connected between said inverter and said third inverter circuit, and c) a feedback capacitance having the same capacitance as said input capacitance, for connecting an output of said inverter to its input;

iii) said third inverter circuit comprises;

a) an inverter comprising an odd number of serial MOS inverters, b) a feedback capacitance for connecting an output of said inverter to its input;

iv) said second inverter circuit comprises;

a) an inverter comprising an odd number of serial MOS inverters, b) an input capacitance connected between an input of said inverter and said second input voltage, and c) a feedback capacitance having the same capacitance as said input capacitance, for connecting an output of said inverter to its input;

v) said first maximum circuit comprises four nMOSs to drains of which a supply voltage is connected, to gates of which said first and second voltages and said outputs of said first and second inverter circuits are connected, and sources of which are integrated as a common output and grounded through a high resistance;

vi) said second maximum circuit comprises two nMOSs to drains of which said supply voltage is connected, to gates of which said first voltage, and said output of said first inverter circuit are connected, and sources of which are integrated as a common output and grounded through a high resistance;

vii) said third maximum circuit comprises four nMOSs to drains of which said supply voltage is connected, to gates of which said second voltage and said output of said second inverter circuits are connected, and sources of which are integrated as a common output, and grounded through a high resistance; and viii) said minimum circuit comprises two pMOSs drains of which are grounded, to gates of which said outputs of said second and third maximum circuits are connected, respectively, and sources of which are integrated as a common output and connected through a high resistance to said supply voltage.

5. A complex number calculation circuit as claimed in claim 4, wherein a capacitance of said feedback capacitance of said third inverter circuit is the same as a capacitance connected to said first maximum circuit of said capacitive coupling.

6. A complex number calculation circuit as claimed in claim 4, wherein said feedback capacitance of said third inverter circuit has a capacitance 10/11 times as large as said capacitance connected to said first maximum circuit.

7. A complex number calculation circuit comprising:

i) a first absolute value circuit to which a first input voltage corresponding to a real part of a complex number is connected;

ii) a second absolute value circuit to which a second voltage corresponding to an imaginary part of said complex number is connected;

iii) a comparison circuit to which outputs of said first and second absolute value circuits are connected for generating a binary output according to values of said outputs;

iv) a first capacitive coupling with two capacitances to which an output of said first and second absolute value circuits are connected for generated a binary output according to values of said outputs;

v) a first inverter circuit to which an output of said first capacitive coupling is connected;

vi) a second capacitive coupling with two capacitances to which an output of said first and second absolute value circuits are connected for weighting and adding said outputs of said first and second absolute value by a ratio of 1:2;

vii) a second inverter circuit to which at output of a second capacitive coupling is connected;

viii) a multiplexer to which said outputs of said first and second inverter circuits are inputted, said multiplexer being switched by an output of said comparison circuit; and ix) a third inverter circuit to which an output of said multiplexer is connected.

8. A complex number calculation circuit as claimed in claim 7, wherein i) said first absolute value circuit comprises;

a) a MOS inverter to which said first input voltage is connected, b) an inverter circuit to which said first input voltage is connected, which comprises, b-1) an inverter consisting of an odd number of serial MOS inverters, b-2) an input capacitance connected between an input of said inverter and said first input voltage, and b-3) a feedback capacitance having the same capacitance as said input capacitance, for connecting an output of said inverter to its input, c) a multiplexer to which an output of said inverter circuit and said first input voltage are inputted, said multiplexer being switched by an output of said MOS inverter;

ii) said second absolute value circuit comprises;

a) a MOS inverter to which said second input voltage is connected, b) an inverter circuit to which said second input voltage is connected, which comprises, b-1) an inverter consisting of an odd number of serial MOS inverters, b-2) an input capacitance connected between an input of said inverter and said second input voltage, and b-3) a feedback capacitance having the same capacitance as said input capacitance, for connecting an output of said inverter to its input; and c) a multiplexer to which an output of said inverter circuit and said second input voltage are inputted, said multiplexers being switched by an output of said MOS inverter;

iii) said first inverter circuit comprises;

a) an inverter consisting of an odd number of serial MOS inverters; and b) a feedback capacitance for connecting an output of said inverter to its input;

iv) said second inverter circuit comprises:

a) an inverter consisting of an odd number of serial MOS inverters; and b) a feedback capacitance for connecting an output of said inverter to its input;

v) said third inverter circuit comprises:

a) an inverter consisting of an odd number of serial MOS inverters;

b) an input capacitance connected between said inverter and said multiplexer; and c) a feedback capacitance having the same capacitance as said input capacitance, for connecting an output of said inverter to its input.

9. A complex number calculation circuit as claimed in claim 8, wherein a capacitance of said feedback capacitance of said first inverter circuit is the same as said capacitance connected to said first absolute value circuit in said first capacitive coupling, and a capacitance of said feedback capacitance of said second inverter circuit is the same as said capacitance connected to the second absolute value circuit in said second capacitive coupling.

10. A complex number calculation circuit as claimed in claim 8, wherein a capacitance of said feedback capacitance of said first inverter circuit is 10/11 times as large as said capacitance of the first capacitive coupling which is connected to said first absolute value circuit, and a capacitance of said feedback capacitance of said second inverter circuit is 10/11 times as large as said capacitance of the second capacitive coupling which is connected to said second absolute value circuit.

11. A complex number calculation circuit as claimed in claim 7, wherein said comparison circuit comprises;

i) an inverter circuit to which an output of said first absolute value circuit, is connected, which comprises;

a) an inverter consisting of an odd number of serial MOS inverters, b) an input capacitance connected between an input of said inverter and said first absolute value circuit, and c) a feedback capacitance having the same capacitance as said input capacitance for connecting an output of said inverter to its input;

ii) a capacitive coupling having two capacitances connected to outputs of said inverter circuit and said second absolute value circuit, respectively, for weighting said outputs by a ratio of 1:1; and iii) an odd number of serial MOS inverters to which an output of said capacitive coupling is connected.

12. A complex number calculation circuit as claimed in claim 7, wherein i) said multiplexer comprises a pair of MOS switches and a MOS inverter, ii) an output of said comparison circuit is directly inputted to a gate of one of said MOS switches, as well as, being inputted to a gate of another MOS switch through said MOS inverter, iii) outputs of said first and second inverter circuits are connected to inputs of said MOS switches, respectively, iv) outputs of both MOS switches are connected to each other as a common output.

13. A complex number calculation circuit, comprising:

i) a first absolute value circuit to which a first input voltage corresponding to a real part of a complex number is connected, and which generates an output corresponding to an absolute value of said real part;

ii) a second absolute value circuit to which a second voltage corresponding to an imaginary part of said complex number is connected, and which generates an output corresponding to an absolute value of said imaginary part; and iii) a weighted addition circuit for weighting with a weight of 15/22 and adding said outputs of said first and second absolute value circuits.

14. A complex number calculation circuit comprising:

i) a first absolute value circuit to which a first input voltage corresponding to a real part of a complex number is connected, and which generates an output corresponding to an absolute value of said real part;

ii) a second absolute value circuit to which a second voltage correstonding to an imaginary part of said complex number is connected, and which generates an output corresponding to an absolute value of said imaginary part; and iii) a weichted addition circuit for weighting with a weight of 15/22 and adding said outputs of said first and second absolute value circuits, wherein said first absolute value circuit comprises:

a) a MOS inverter to which said first input voltage is connected, b) an inverter circuit to which said first input voltage is connected, which comprises, b-1) an inverter consisting of an odd number of serial MOS inverters, b-2) an input capacitance connected between an input of said inverter and said first input voltage, and b-3) a feedback capacitance having the same capacitance as said input capacitance, for connecting an output of said inverter to its input; and c) a multiplexer to which an output of said inverter circuit and said first input voltage are inputted, said multiplexer being switched by an output of said MOS inverter; and said second absolute value circuit comprises:

a) a MOS inverter to which said second input voltage is connected, b) an inverter circuit connected to said second input voltage, which comprises;

b-1) an inverter consisting of an odd number of serial MOS inverters, b-2) an input capacitance connected between an input of said inverter and said second input voltage, and b-3) a feedback capacitance having the same capacitance as said input capacitance, for connecting an output of said inverter to its input; and c) a multiplexer to which an output of said inverter circuit and said second input voltage are inputted, said multiplexer being switched by an output of said MOS inverter.

15. A complex number calculation circuit comprising:

i) a first absolute value circuit to which a first input voltage corresonding to a real part of a complex number is connected, and which generates an output corresponding to an absolute value of said real part;

ii) a second absolute value circuit to which a second voltage corresponding to an imaginary part of said complex number is connected, and which generates an output corresponding to an absolute value of said imaginary part; and iii) a weighted addition circuit for weighting with a weight of 15/22 and adding said outputs of said first and second absolute value circuits, wherein said weighted addition circuit comprises:

i) a capacitive coupling with two capacitances having a capacitance ratio of 1:1 to which outputs of said first and second absolute value circuits are connected, respectively;

ii) a first inverter circuit consisting of an odd number of serial MOS inverters and connected to an output of said capacitive coupling;

iii) a first feedback capacitance for connecting an output of said first inverter circuit to its input;

iv) an input capacitance to which an output side of said first feedback capacitance is connected;

v) a second inverter circuit consisting of an odd number of serial MOS inverters to which the output side of said first feedback capacitance is connected via said input capacitance;

vi) a second feedback capacitance having the same capacitance as said input capacitance, for connecting an output of said second inverter circuit to its input;

wherein a capacitance ratio of each capacitance connected to an output of said absolute value circuit, said first feedback capacitance, said input capacitance, and said second feedback capacitance is 3:4:4:4.

16. A complex number calculation circuit as claimed in claim 15, wherein said capacitive coupling further comprises a capacitance of the same capacity as said fccdback capacitance, to which an analog voltage is impressed of a value of constant times as large as a peak-to-peak voltage of said input voltage.

17. A complex number calculation circuit as claimed in claim 16, wherein said constant is 0.250.

18. A complex number calculation circuit as claimed in claim 16, wherein said constant is 0.125.

19. A complex number calculation circuit comprising:

i) a first absolute value circuit to which a first input voltage corresponding to a real part of a complex number is connected, and which generates an output corresponding to an absolute value of said real part;

ii) a second absolute value circuit to which a second voltage corresponding an imaginary part of said complex number is connected, and which generates an output corresponding to an absolute value of said imaginary part;

iii) a subtraction circuit to which outputs of said first and second absolute value circuits are connected, for subtracting the output of said second absolute value circuit from the output of said first absolute value circuit;

iv) a third absolute value circuit connected to an output of said subtraction circuit; and v) a weighted addition circuit for weighting an output of said third absolute value circuit and the outputs of said first and second absolute value circuit with weights which achieve a ratio of 1:3:3, respectively, and for adding results of said weighting.

20. A complex number calculation circuit comprising:

i) a first absolute value circuit to which a first input voltage corresponding to a real part of a complex number is connected, and which generates an output corresponding to an absolute value of said real part;

ii) a second absolute value circuit to which a second voltage corresponding an imaginary part of said complex number is connected, and which generates an output corresponding to an absolute value of said imaginary part;

iii) a subtraction circuit to which outputs of said first and second absolute value circuits are connected, for subtracting the output of said second absolute value circuit from the output of said first absolute value circuit;

iv) a third absolute value circuit connected to an output of said subtraction circuit; and v) a weighted addition circuit for weighting an output of said third absolute value circuit and the outputs of said first and second absolute value circuits with weights which achieve a ratio of 1:3:3, respectively, and for adding results of said weighting, wherein said first absolute value circuit comprises:

a) a MOS inverter to which said first input voltage is connected, b) an inverter circuit to which said first input voltage is connected, which comprises, b-1) an inverter consisting of an odd number of serial MOS inverters, b-2) an input capacitance connected between an input of said inverter and said first input voltage, and b-3) a feedback capacitance having the same capacitance as said input capacitance, for connecting an output of said inverter to its input; and c) a multiplexer to which an output of said inverter circuit and said first input voltage are inputted, said multiplexer being switched by an output of said MOS inverter;

said second absolute value circuit comprising:

a) a MOS inverter to which said second input voltage is connected, b) an inverter circuit to which said second input voltage is connected, which comprises;

b-1) an inverter consisting of an odd number of serial MOS inverters, b-2) an input capacitance connected between an input of said inverter and said second input voltage, and b-3) a feedback capacitance having the same capacitance as said input capacitance, for connecting an output of said inverter to its input; and c) a multiplexer to which an output of said inverter circuit and said second input voltage are inputted, said multiplexer being switched by an output of said MOS inverter;

said third absolute value circuit comprising:

a) a MOS inverter to which an output of said subtraction circuit is connected;

b) an inverter circuit to which an output of said subtraction circuit is connected, which comprises;

b-1) an inverter consisting of an odd number of serial MOS inverters, b-2) an input capacitance connected between an input of said inverter and said output of said subtraction circuit, b-3) a feedback capacitance having the same capacitance as said input capacitance, for connecting an output of said inverter to its input, and c) a multiplexer to which an output of said inverter circuit and said output of said subtraction circuit are inputted, said multiplexer being switched by an output of said MOS inverter.

21. A complex number calculation circuit comprising:

i) a first absolute value circuit to which a first input voltage corresponding to a real part of a complex number is connected, and which generates an output corresponding to an absolute value of said real part;

ii) a second absolute value circuit to which a second voltage corresponding an imaginary part of said complex number is connected, and which generates an output corresponding to an absolute value of said imaginary part;

iii) a subtraction circuit to which outputs of said first and second absolute value circuits are connected, for subtracting the output of said second absolute value circuit from the output of said first absolute value circuit;

iv) a third absolute value circuit connected to an output of said subtraction circuit; and v) a weighted addition circuit for weighting an output of said third absolute value circuit and the outputs of said first and second absolute value circuits with weights which achieve a ratio of 1:3:3, respectively, and for adding results of said weighting, wherein said subtraction circuit comprises:

i) a first input capacitance to which an output of said first absolute value circuit is connected;

ii) a first inverter circuit consisting of an odd number of said MOS inverters, to which an output side of said first input capacitance is connected;

iii) a first feedback capacitance having the same capacitance as said first input capacitance, for connecting an output of said first inverter circuit to its input;

iv) a capacitive coupling with two capacitances to which outputs of said second absolute value circuit and said first inverter circuit are connected, respectively;

v) a second inverter circuit consisting of an odd number of serial MOS inverters to which an output of said capacitive coupling is connected; and vi) a second feedback capacitance having the same capacitance as a total of the capacitances which define said capacitive coupling, for connecting an output of said second inverter to its input.

22. A complex number calculation circuit comprising:

i) a first absolute value circuit to which a first input voltage corresponding to a real part of a complex number is connected, and which generates an output corresponding to an absolute value of said real part;

ii) a second absolute value circuit to which a second voltage corresponding an imaginary part of said complex number is connected, and which generates an output corresponding to an absolute value of said imaginary part;

iii) a subtraction circuit to which outputs of said first and second absolute value circuits are connected, for subtracting the output of said second absolute value circuit from the output of said first absolute value circuit;

iv) a third absolute value circuit connected to an output of said subtraction circuit; and v) a weighted addition circuit for weighting an output of said third absolute value circuit and the outputs of said first and second absolute value circuits with weights which achieve a ratio of 1:3:3, respectively, and for adding results of said weighting, wherein said weighted addition circuit comprises:

i) a capacitive coupling correlatively with a capacitance ratio of 3:3:1 which are connected to outputs of said first, second and third absolute value circuits, respectively;

ii) a first inverter circuit consisting of an odd number of serial MOS inverters to which to an output of said capacitive coupling is connected;

iii) a first feedback capacitance for connecting an output of said first inverter circuit to its input;

iv) an input capacitance to which an output of said first inverter circuit is connected;

v) a second inverter circuit consisting of an odd number of serial MOS inverters to which an output side of said input capacitance is connected;

vi) a second feedback capacitance having the same capacitance as said input capacitance for connecting an output of said second inverter to its input.

23. A complex number calculation circuit as claimed in claim 22, wherein a capacitance of said first feedback capacitance is 22/5 times as large as the capacitance in said capacitive coupling which connects to said third absolute value circuit.

24. A complex number calculation circuit as claimed in claim 22, wherein a capacitance of said second feedback capacitance is 22/15 times as large as capacitances in said capacitive coupling which respectively connect to said first and second absolute value circuits.

* * * * *

UNITED STATES PATENT AND TRADEMARK OFFICE

CERTIFICATE OF CORRECTION

PATENT NO. : 5,751,624

DATED : May 12, 1998

INVENTOR(S) : Zhou, et al.

It is certified that error appears in the above-identified patent and that said Letters Patent is hereby corrected as shown below:

Column 20, lines 33, delete "10/11" and insert --11/10--.

Column 20, lines 37, delete "10/11" and insert --11/10--.

Signed and Sealed this

Sixteenth Day of February, 1999

*Attest:*

*Attesting Officer*

*Acting Commissioner of Patents and Trademarks*